US010823193B2

(12) United States Patent
Rau et al.

(10) Patent No.: US 10,823,193 B2
(45) Date of Patent: Nov. 3, 2020

(54) ALIGNMENT AND CENTERING FEATURES FOR FAN ASSEMBLY

(71) Applicant: Carrier Corporation, Palm Beach Gardens, FL (US)

(72) Inventors: Mark Patrick Rau, Fairport, NY (US); Ryan K. Dygert, Cicero, NY (US); Richie C. Stauter, Fayetteville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 44 days.

(21) Appl. No.: 16/238,118

(22) Filed: Jan. 2, 2019

(65) Prior Publication Data

US 2019/0203733 A1 Jul. 4, 2019

Related U.S. Application Data

(60) Provisional application No. 62/612,909, filed on Jan. 2, 2018.

(51) Int. Cl.

| | |
|---|---|
| ***F04D 29/32*** | (2006.01) |
| ***F04D 25/06*** | (2006.01) |
| ***F04D 29/26*** | (2006.01) |
| ***F04D 29/34*** | (2006.01) |
| *F04D 29/38* | (2006.01) |

(52) U.S. Cl.

CPC ..... *F04D 29/329* (2013.01); *F04D 25/06* (2013.01); *F04D 29/263* (2013.01); *F04D 29/34* (2013.01); *F04D 29/38* (2013.01); *F05D 2260/37* (2013.01)

(58) Field of Classification Search

None

See application file for complete search history.

(56) References Cited

U.S. PATENT DOCUMENTS

| | | | |
|---|---|---|---|
| 5,871,335 | A | 2/1999 | Bartlett |
| 6,039,536 | A | 3/2000 | Van De Venne et al. |
| 6,073,593 | A | 6/2000 | Nilson et al. |
| 6,527,516 | B2 | 3/2003 | Crevel |
| 7,259,486 | B2 | 8/2007 | Yamamoto |

(Continued)

FOREIGN PATENT DOCUMENTS

| | | | |
|---|---|---|---|
| DE | 8511987 | U1 | 6/1985 |
| DE | 102016002832 | A1 | 9/2017 |

(Continued)

OTHER PUBLICATIONS

European Search Report Issued in EP Application No. 18214464.2, dated May 17, 2019, 8 Pages.

*Primary Examiner* — Igor Kershteyn
*Assistant Examiner* — Juan G Flores
(74) *Attorney, Agent, or Firm* — Cantor Colburn LLP

(57) ABSTRACT

A fan assembly includes a fan and a fan drive. The fan includes a fan hub located at a fan central axis, and a plurality of fan blades extending outwardly from the fan hub. The fan hub has a fan hub opening at the fan central axis. The fan hub opening is at least partially defined by a plurality of nodes extending radially inwardly toward the fan central axis from the fan hub. The fan drive is installed in the fan hub opening via an interference fit between the plurality of nodes and an outer surface of the fan drive, thus centering the fan drive in the fan hub opening.

16 Claims, 5 Drawing Sheets

(56) References Cited

U.S. PATENT DOCUMENTS

| | | | | |
|---|---|---|---|---|
| 7,442,010 | B2 * | 10/2008 | Gruber | F04D 29/329 416/169 A |
| 2005/0287005 | A1 | 12/2005 | Gruber et al. | |
| 2013/0280090 | A1 | 10/2013 | Sato et al. | |
| 2015/0125326 | A1 * | 5/2015 | Levasseur | F04D 25/0613 417/423.14 |
| 2017/0194834 | A1 | 7/2017 | Simofi-Ilyes et al. | |
| 2017/0321706 | A1 | 11/2017 | Roessler et al. | |

FOREIGN PATENT DOCUMENTS

| | | | |
|---|---|---|---|
| GB | 2011582 | A | 7/1979 |
| GB | 2142120 | A | 1/1985 |
| GB | 2355295 | A | 4/2001 |
| GB | 2401656 | A | 11/2004 |
| WO | 9730621 | | 8/1997 |

* cited by examiner

ALIGNMENT AND CENTERING FEATURES FOR FAN ASSEMBLY

CROSS-REFERENCE TO RELATED APPLICATIONS

This application claims the benefit of U.S. Provisional Application No. 62/612,909, filed Jan. 2, 2018, which is incorporated herein by reference in its entirety.

BACKGROUND

Exemplary embodiments pertain to the art of heating, ventilation, air conditioning and refrigeration (HVAC&R) systems. More particularly, the present disclosure relates to fan assemblies for HVAC&R systems.

HVAC&R systems typically include one or more fans for air management. Examples of such fans include condenser fans to urge airflow across a condenser of the HVAC&R system, and evaporator fans to likewise urge airflow across an evaporator of the HVAC&R system. In some fan assemblies, the fan is secured to a fan drive at a fan hub opening.

BRIEF DESCRIPTION

In one embodiment, a fan assembly includes a fan and a fan drive. The fan includes a fan hub located at a fan central axis, and a plurality of fan blades extending outwardly from the fan hub. The fan hub has a fan hub opening at the fan central axis. The fan hub opening is at least partially defined by a plurality of nodes extending radially inwardly toward the fan central axis from the fan hub. The fan drive is installed in the fan hub opening via an interference fit between the plurality of nodes and an outer surface of the fan drive, thus centering the fan drive in the fan hub opening.

Additionally or alternatively, in this or other embodiments the plurality of nodes are three or more nodes.

Additionally or alternatively, in this or other embodiments each node of the plurality of nodes extends radially inwardly along a flange of the fan hub.

Additionally or alternatively, in this or other embodiments the plurality of nodes define contact areas between the fan hub and the fan drive.

Additionally or alternatively, in this or other embodiments a node of the plurality of nodes includes a pocket to increase a deformability of the node during installation of the fan to the fan drive.

Additionally or alternatively, in this or other embodiments the pocket is a localized reduction in axial thickness of the node.

Additionally or alternatively, in this or other embodiments the pocket is substantially oval-shaped.

Additionally or alternatively, in this or other embodiments a plurality of fasteners axially and circumferentially retain the fan to the fan drive.

Additionally or alternatively, in this or other embodiments each fastener of the plurality of fasteners is located to circumferentially align with a node of the plurality of nodes.

Additionally or alternatively, in this or other embodiments a fan shroud is located at a blade tip of the plurality of fan blades.

Additionally or alternatively, in this or other embodiments the fan drive includes an electric motor.

In another embodiment, a heating, ventilation, air conditioning and refrigeration (HVAC&R) system includes one or more heat exchangers and one or more fan assemblies to urge airflow across the one or more heat exchangers. A fan assembly of the one or more fan assemblies includes a fan and a fan drive. The fan includes a fan hub located at a fan central axis and a plurality of fan blades extending outwardly from the fan hub. The fan hub has a fan hub opening at the fan central axis. The fan hub opening is at least partially defined by a plurality of nodes extending radially inwardly toward the fan central axis from the fan hub. The fan drive is installed in the fan hub opening via an interference fit between the plurality of nodes and an outer surface of the fan drive, thus centering the fan drive in the fan hub opening.

Additionally or alternatively, in this or other embodiments the plurality of nodes are three or more nodes.

Additionally or alternatively, in this or other embodiments each node of the plurality of nodes extends radially inwardly along a flange of the fan hub.

Additionally or alternatively, in this or other embodiments the plurality of nodes define contact areas between the fan hub and the fan drive.

Additionally or alternatively, in this or other embodiments a node of the plurality of nodes includes a pocket to increase a deformability of the node during installation of the fan to the fan drive.

Additionally or alternatively, in this or other embodiments the pocket is a localized reduction in axial thickness of the node.

Additionally or alternatively, in this or other embodiments the pocket is substantially oval-shaped.

Additionally or alternatively, in this or other embodiments a plurality of fasteners axially and circumferentially retain the fan to the fan drive.

Additionally or alternatively, in this or other embodiments each fastener of the plurality of fasteners is located to circumferentially align with a node of the plurality of nodes

BRIEF DESCRIPTION OF THE DRAWINGS

The following descriptions should not be considered limiting in any way. With reference to the accompanying drawings, like elements are numbered alike.

DETAILED DESCRIPTION

For good performance of the fan assembly, control of balance, concentricity, runout precision, and repeatability is necessary between the fan and fan drive. Further, in some fan assemblies, the fan is a molded plastic component, which may have a higher than desired degree of variability, and thus accurate and repeatable assembly of the fan to the fan drive may require secondary operations, which reduces manufacturing efficiency.

A detailed description of one or more embodiments of the disclosed apparatus and method are presented herein by way of exemplification and not limitation with reference to the Figures.

Figure 1:
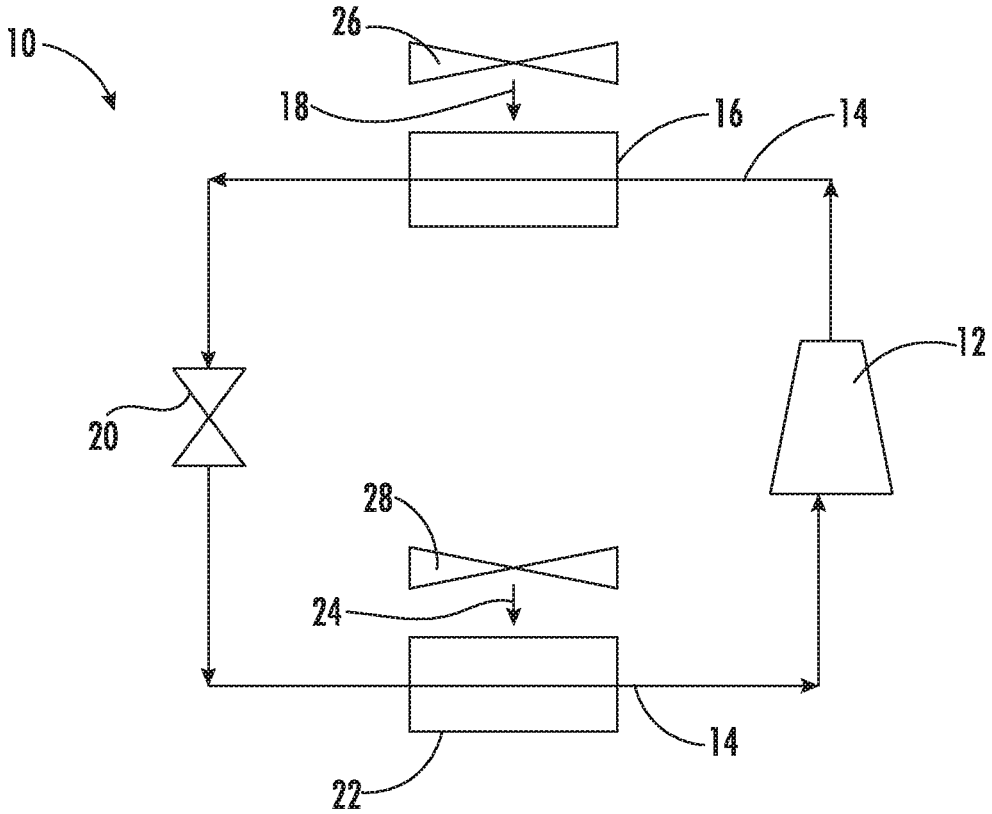
FIG. 1 is a schematic view of an embodiment of a heating, ventilation, air conditioning and ventilation (HVAC&R) system.

Referring to FIG. 1, a schematic of a heating, ventilation, air conditioning, and refrigeration (HVAC&R) system 10 is illustrated. The HVAC&R system 10 includes a compressor 12 to compress a flow of vapor refrigerant 14 therethrough. The compressed refrigerant 14 is changed to liquid phase at a condenser 16 via thermal energy exchange with a condenser airflow 18. The condenser 16 is fluidly connected to an expansion device 20, which is, in turn, fluidly connected to an evaporator 22. An evaporator airflow 24 is directed across the evaporator 22, which cools the evaporator airflow 24 and boils the flow of refrigerant 14 therethrough. The now vaporized flow of refrigerant 14 is returned to the compressor 12.

In some embodiments, a condenser fan 26 is located at the condenser 16 to direct the condenser airflow 18 across the condenser 16. Further, an evaporator fan 28 may be located at the evaporator 22 to direct the evaporator airflow 24 across the evaporator 22.

Figure 2:
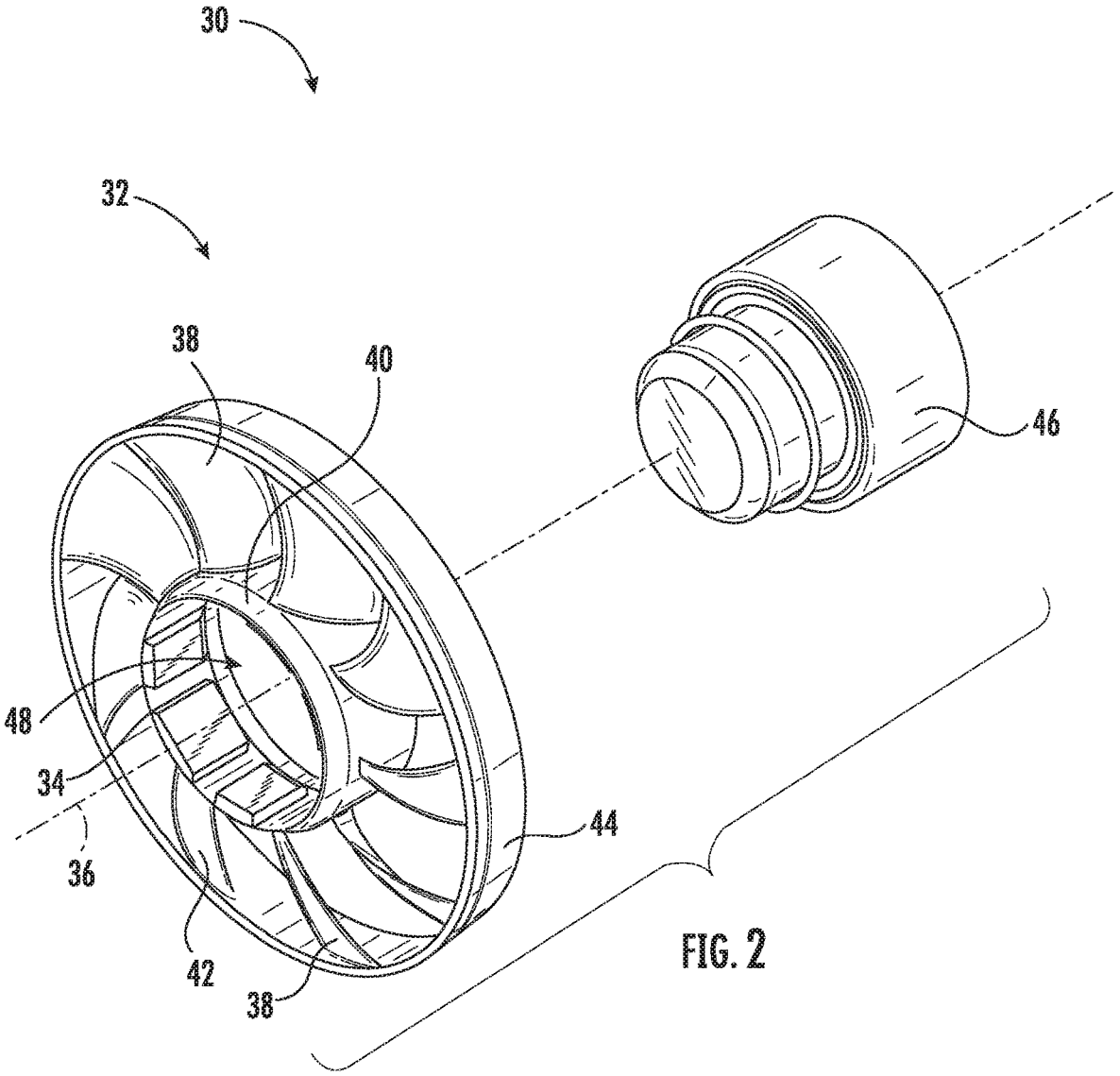
FIG. 2 is a partially exploded schematic view of an embodiment of a fan assembly.

Referring now to the partially exploded view of FIG. 2, an embodiment of a fan assembly 30 is illustrated. The fan assembly 30 may be utilized as a condenser fan 26, an evaporator fan 28, or another fan which is a component of the HVAC&R system 10. While the description and drawings herein relate to a fan assembly 30 for an HVAC&R system 10, one skilled in the art will appreciate that fan assembly 30 may be utilized in other air management applications.

The fan assembly 30 includes a fan 32 having a fan hub 34 located at a fan central axis 36, with a plurality of fan blades 38 extending radially outwardly therefrom. The fan blades 38 extend from a blade root 40 at the fan hub 34 to a blade tip 42 opposite the blade root 40. In some embodiments, the fan 32 includes a fan shroud 44 secured to the fan blades 38 at or near the blade tips 42. The fan assembly 30 further includes a fan drive 46 secured to the fan hub 34 to drive rotation of the fan 32 about the fan central axis 36. In some embodiments, the fan drive 46 includes a prime mover, such as an electric motor. The fan drive 46 is located at the fan central axis 36, and is coaxial with the fan 32, and is installed to the fan 32 at the fan hub 34, in particular at a fan hub opening 48 at the fan central axis 36. In some embodiments, the fan 32 is formed from a molded plastic material such as, for example, nylon or polypropylene materials. It is to be appreciated, however, that these materials are merely exemplary and that other materials may be utilized.

Figure 3:
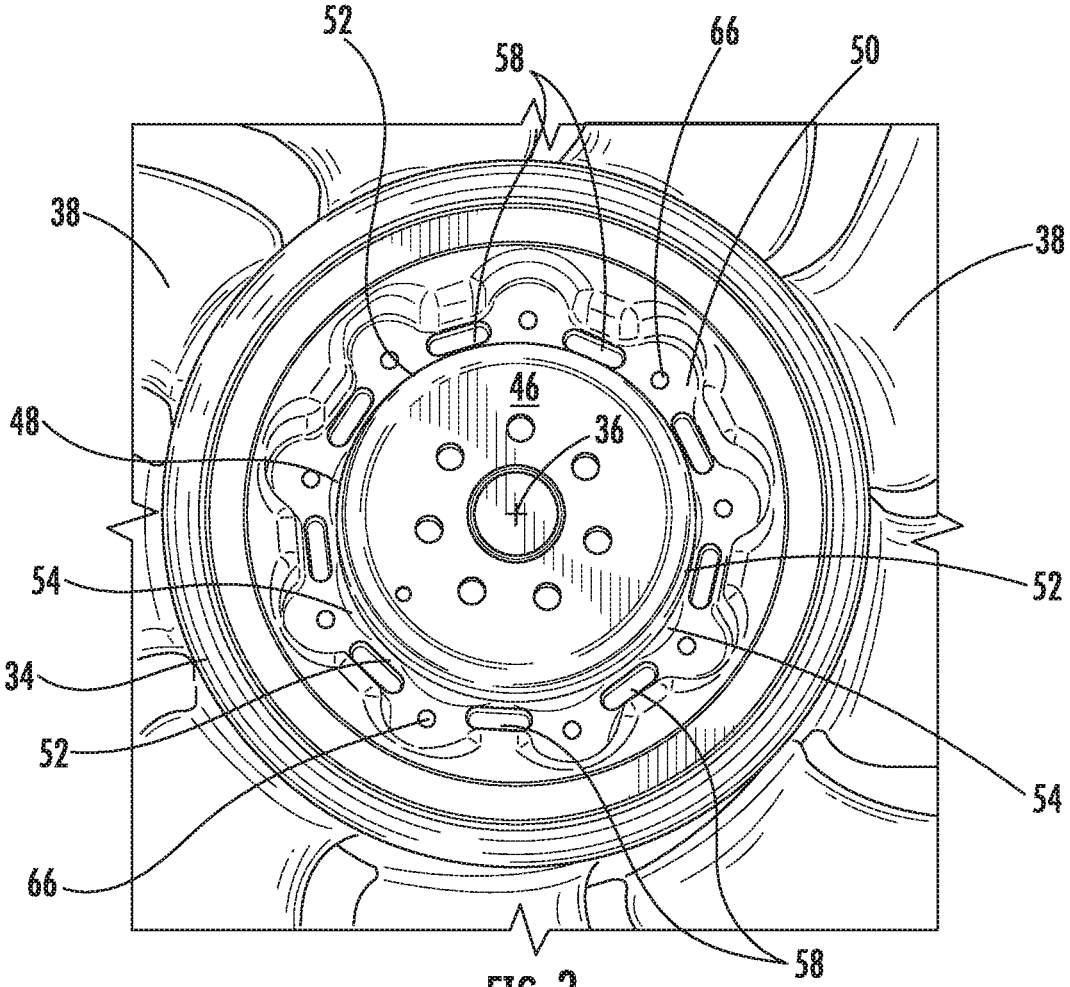
FIG. 3 is a plan view of an embodiment of a fan assembly.
Figure 4:
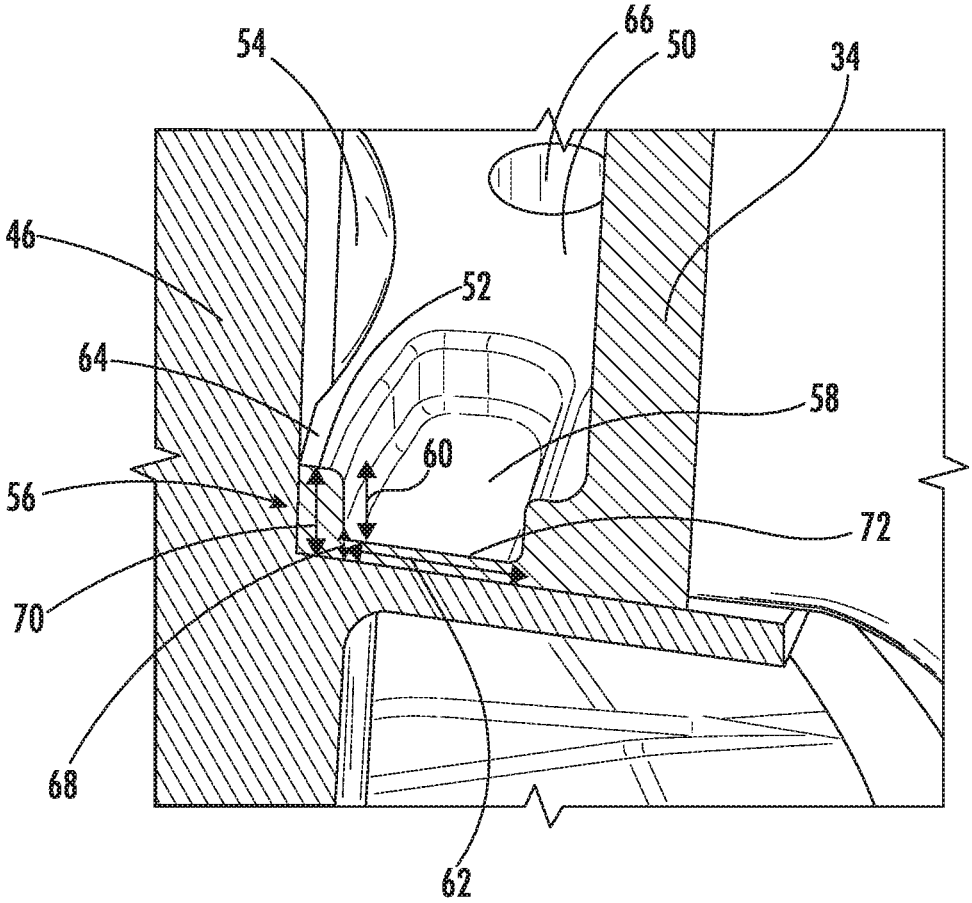
FIG. 4 is a partial cross-sectional view of an interface between a fan drive and a fan of an embodiment of a fan assembly.

Referring now to FIG. 3, the fan hub opening 48 is defined by a radially-extending fan hub flange 50 including a plurality of lobes 52 defining contact areas between the fan 32 and the fan drive 46, as shown in FIG. 4. In some embodiments, the plurality of lobes is at least three lobes 52, to center the fan 32 at the fan drive 46 when the fan 32 is installed to the fan drive 46. The fan hub flange 50 has a plurality of flange surfaces 54, each flange surface 54 located between adjacent lobes 52. In some embodiments, the flange surface 54 is located at a first radial distance from the fan central axis 36, while the lobes 52 have a radially inboard extent located at a second radial distance from the fan central axis 36, less than the first radial distance. Further, the second radial distance is less than a fan drive radius 56, such that each lobe 52 has an interference fit with the fan drive 46 when the fan 32 is installed at the fan drive 46, as shown in FIG. 4. The interference fit of the lobes 52 to the fan drive 46 centers the fan 32 at the fan drive 46 and about the fan central axis 36.

Figure 5:
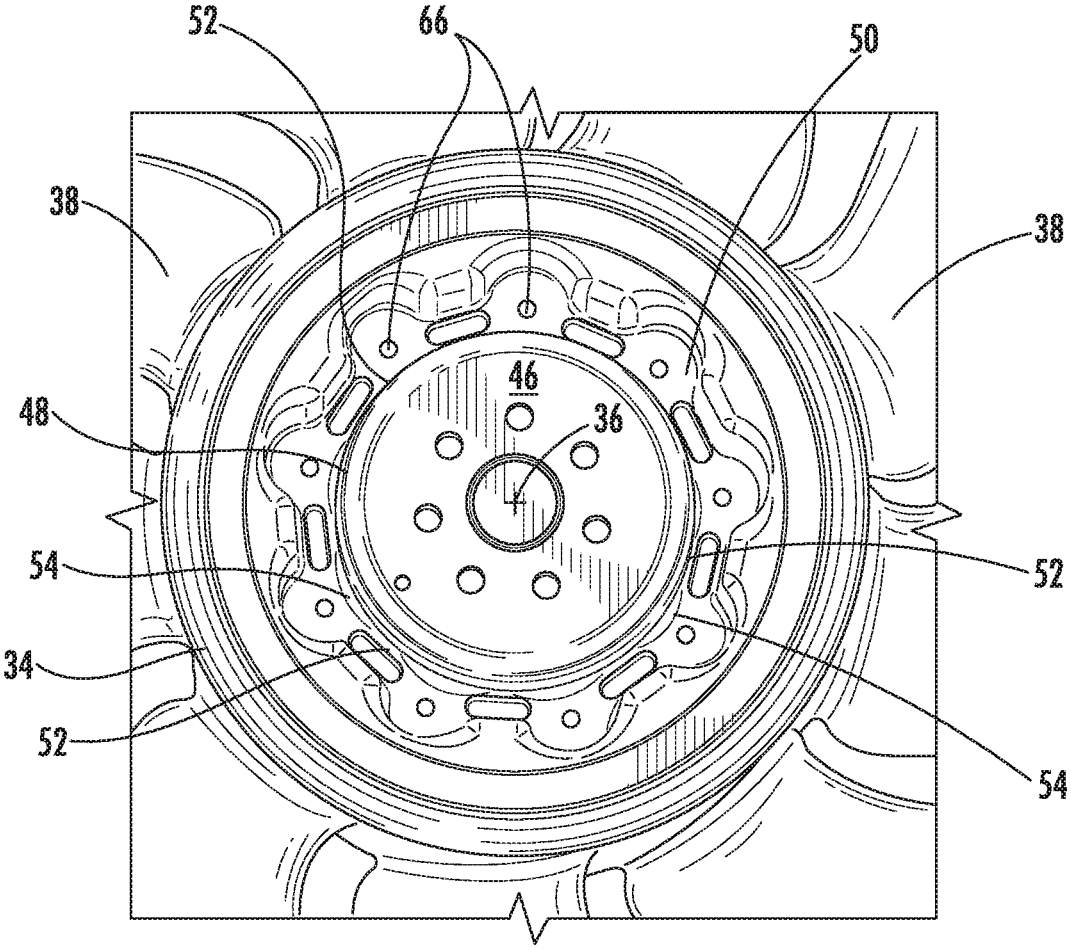
FIG. 5 is a plan view of another embodiment of a fan assembly.

The lobes 52 have pockets 58 formed therein. Each pocket 58 has a pocket depth 60 and a pocket width 62 and is located such that the pocket 58 and lobe 52 define a lobe wall 64 that abuts the fan drive 46. The pocket 58 is thus a localized reduction of axial thickness of the node 52. The pocket 58 size, shape and location is defined to tune an installation force of the fan 32 to the fan drive 46 to a selected installation force. In some embodiments, the pockets 58 are formed such that a pocket base 72 has a base thickness 68 of between 15% and 40% of a lobe thickness 70 of the lobe 52. Referring again to FIG. 3, in some embodiments the pockets 58 have an oval shape, while in other embodiments the pockets 58 may have other shapes, such as circular or elliptical. While in some embodiments, such as shown in FIGS. 3 and 4, the lobes 52 have pockets 58, in other embodiments the lobes 52 may be formed without pockets 58 such as in the embodiment shown in FIG. 5. Embodiments without pockets 58 rely more on compression of material than deformation of the feature, resulting in a higher installation force, compared to the embodiments without pockets 58. In embodiments such as in FIGS. 3 and 4 including lobes 52 and pockets 58, the lobes 52 may be configured to primarily elastically deform (e.g. the amount of plastic deformation is less than the amount of elastic deformation under a selected load scenario) in cases where reduced installation force is desired or where the parent material strength & stiffness is sufficiently high to limit the amount of plastic deformation. In other embodiments, such as those without pockets, the lobes 52 may be configured to primarily plastically deform (e.g. the amount of plastic deformation is greater than the amount of elastic deformation under a selected load scenario) in situations or configurations where the installation force can be allowed to be higher or where the parent material strength & stiffness allows sufficient plastic deformation.

Referring again to FIG. 2, once installed onto the fan drive 46, a plurality of fasteners 66 are installed into the fan drive 46 through the hub flange 50. The fasteners 66 may be positioned between adjacent lobes 52 as shown in FIG. 2, or may alternatively be located at the lobes 52, and in some embodiments in the pockets 58. The fasteners 66 provide axial and circumferential retention of the fan 32 to the fan drive 46.

The present disclose including the interference fit of the fan 32 to the fan drive 46 allows the fan 32 to be installed to the fan drive 46 accurately and without high cost and time consuming secondary operation, such as machining or the use of an overmolded metallic fan hub.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A fan assembly, comprising:

a fan, including:

a fan hub located at a fan central axis; and a plurality of fan blades extending outwardly from the fan hub;

the fan hub having a fan hub opening at the fan central axis, the fan hub opening at least partially defined by a plurality of nodes extending radially inwardly toward the fan central axis from the fan hub; and a fan drive installed in the fan hub opening via an interference fit between the plurality of nodes and an outer surface of the fan drive, thus centering the fan drive in the fan hub opening;

wherein a node of the plurality of nodes includes a pocket to increase a deformability of the node during installation of the fan to the fan drive, the pocket including:

a inner radial surface an outer radial surface; and a base surface extending between the inner radial surface and the outer radial surface; and wherein the pocket is a localized reduction in axial thickness of the node.

2. The fan assembly of claim 1, wherein the plurality of nodes are three or more nodes.

3. The fan assembly of claim 1, wherein each node of the plurality of nodes extends radially inwardly along a flange of the fan hub.

4. The fan assembly of claim 1, wherein the plurality of nodes define contact areas between the fan hub and the fan drive.

5. The fan assembly of claim 1, wherein the pocket is substantially oval-shaped.

6. The fan assembly of claim 1, further comprising a plurality of fasteners to axially and circumferentially retain the fan to the fan drive.

7. The fan assembly of claim 6, wherein each fastener of the plurality of fasteners is located to circumferentially align with a node of the plurality of nodes.

8. The fan assembly of claim 1, wherein a fan shroud is located at a blade tip of the plurality of fan blades.

9. The fan assembly of claim 1, wherein the fan drive comprises an electric motor.

10. A heating, ventilation, air conditioning and refrigeration (HVAC&R) system, comprising:

one or more heat exchangers; and one or more fan assemblies to urge airflow across the one or more heat exchangers, a fan assembly of the one or more fan assemblies including:

a fan, including:

a fan hub located at a fan central axis; and a plurality of fan blades extending outwardly from the fan hub;

the fan hub having a fan hub opening at the fan central axis, the fan hub opening at least partially defined by a plurality of nodes extending radially inwardly toward the fan central axis from the fan hub; and a fan drive installed in the fan hub opening via an interference fit between the plurality of nodes and an outer surface of the fan drive, thus centering the fan drive in the fan hub opening;

wherein a node of the plurality of nodes includes a pocket to increase a deformability of the node during installation of the fan to the fan drive, the pocket including:

a inner radial surface an outer radial surface; and a base surface extending between the inner radial surface and the outer radial surface; and wherein the pocket is a localized reduction in axial thickness of the node.

11. The HVAC&R system of claim 10, wherein the plurality of nodes are three or more nodes.

12. The HVAC&R system of claim 10, wherein each node of the plurality of nodes extends radially inwardly along a flange of the fan hub.

13. The HVAC&R system of claim 10, wherein the plurality of nodes define contact areas between the fan hub and the fan drive.

14. The HVAC&R system of claim 10, wherein the pocket is substantially oval-shaped.

15. The HVAC&R system of claim 10, further comprising a plurality of fasteners to axially and circumferentially retain the fan to the fan drive.

16. The HVAC&R system of claim 15, wherein each fastener of the plurality of fasteners is located to circumferentially align with a node of the plurality of nodes.

* * * * *